US011289805B2

(12) United States Patent
Seo et al.

(10) Patent No.: US 11,289,805 B2
(45) Date of Patent: Mar. 29, 2022

(54) DUAL POLARIZED ANTENNA AND ANTENNA ARRAY

(71) Applicant: KMW INC., Hwaseong-si (KR)

(72) Inventors: Yong Won Seo, Daejeon (KR); In Ho Kim, Yongin-si (KR); Hyoung Seok Yang, Hwaseong-si (KR); Oh Seog Choi, Hwaseong-si (KR)

(73) Assignee: KMW INC., Hwaseong-si (KR)

( * ) Notice: Subject to any disclaimer, the term of this patent is extended or adjusted under 35 U.S.C. 154(b) by 0 days.

(21) Appl. No.: 17/093,693

(22) Filed: Nov. 10, 2020

(65) Prior Publication Data

US 2021/0126358 A1 Apr. 29, 2021

Related U.S. Application Data

(63) Continuation of application No. PCT/KR2019/005678, filed on May 10, 2019.

(30) Foreign Application Priority Data

May 10, 2018 (KR) ..... 10-2018-0053659
May 10, 2019 (KR) ..... 10-2019-0055134

(51) Int. Cl.
*H01Q 1/52* (2006.01)
*H01Q 9/04* (2006.01)
(Continued)

(52) U.S. Cl.
CPC ..... *H01Q 1/526* (2013.01); *H01Q 9/0471* (2013.01); *H01Q 21/24* (2013.01); *H01Q 1/246* (2013.01)

(58) Field of Classification Search
CPC ..... H01Q 1/526; H01Q 1/246; H01Q 9/04; H01Q 9/0407; H01Q 9/0471; H01Q 21/24
See application file for complete search history.

(56) References Cited

U.S. PATENT DOCUMENTS 6,246,368 B1 * 6/2001 Deming ..... H01Q 1/42 343/700 MS
10,256,551 B2 * 4/2019 Shehan ..... H01Q 5/30
(Continued)

FOREIGN PATENT DOCUMENTS

DE 10-2008-048289 B3 3/2010
JP 2001-244718 A 9/2001
(Continued)

OTHER PUBLICATIONS

An office action dated Sep. 21, 2021 for Japanese Application No. 2020-562161 and its English translation.
(Continued)

*Primary Examiner* — Lam T Mai
(74) *Attorney, Agent, or Firm* — Insight Law Group, PLLC; Seung Lee

(57) ABSTRACT

The preset invention relates to a dual polarized antenna and an antenna array and, more particularly, to a dual polarized antenna comprising: a top portion having a radiation patch; a bottom portion forming a probe; and side portions formed along the outer peripheral edge of the top portion so as to have a predetermined height, wherein the side portions include a cup-shaped aluminum structure, and the top portion, the bottom portion, and the side portions are formed in an integrated form.

9 Claims, 12 Drawing Sheets

(51) Int. Cl.
*H01Q 21/24* (2006.01)
*H01Q 1/24* (2006.01)

(56) References Cited

U.S. PATENT DOCUMENTS

| | | | | |
|---|---|---|---|---|
| 11,103,925 | B2 * | 8/2021 | Aston | H01Q 13/0283 |
| 2004/0140942 | A1 * | 7/2004 | Gotti | H01Q 21/20 343/810 |
| 2006/0114168 | A1 * | 6/2006 | Gotti | H01Q 1/246 343/797 |
| 2009/0224995 | A1 | 9/2009 | Puente et al. | |
| 2012/0235876 | A1 * | 9/2012 | Harper | H01Q 21/062 343/848 |
| 2013/0009834 | A1 * | 1/2013 | Hefele | H01Q 9/32 343/770 |
| 2016/0248171 | A1 * | 8/2016 | John | H01Q 19/12 |
| 2020/0343649 | A1 * | 10/2020 | Luo | H01Q 25/001 |
| 2021/0063480 | A1 * | 3/2021 | Toben-Heiken | H01Q 1/50 |

FOREIGN PATENT DOCUMENTS

| | | | |
|---|---|---|---|
| JP | 2002-374121 | A | 12/2002 |
| JP | 2005-318438 | A | 11/2005 |
| JP | 2010-220047 | A | 9/2010 |
| KR | 10-0854470 | B1 | 9/2008 |
| KR | 10-2014-0098760 | A | 8/2014 |
| KR | 10-2015-0089509 | A | 8/2015 |
| WO | 2014/045966 | A1 | 3/2014 |
| WO | 2018-010817 | A1 | 1/2018 |

OTHER PUBLICATIONS

International Search Report for PCT/KR2019/005678 dated Aug. 16, 2019 and its English translation.

Extended Search Report dated Dec. 14, 2021 from the European Patent Office for European Application No. 19800916.1.

* cited by examiner

DUAL POLARIZED ANTENNA AND ANTENNA ARRAY

CROSS-REFERENCE TO RELATED APPLICATIONS

This application is a continuation application of International Application No. PCT/KR2019/005678, filed on May 10, 2019, which claims priority and benefits of Korean Application Nos. 10-2018-0053659, filed on May 10, 2018 and 10-2019-0055134, filed on May 10, 2019, the content of which are incorporated herein by reference in their entirety.

TECHNICAL FIELD

The present disclosure relates to a dual polarized antenna and an antenna array, and more particularly, to a dual polarized antenna and an antenna array including a cup-shaped aluminum structure and capable of being manufactured in a simplified process.

BACKGROUND

A wireless communication system includes uplink (UL) and downlink (DL). A base station (BS) can transmit a signal to a user equipment (UE) over the downlink, and the UE can transmit a signal to the BS over the uplink. When duplex communication is supported, the uplink and downlink signals must be separated to avoid mutual interference caused by parallel transmission of signals on the uplink and downlink.

Currently, duplex modes used in wireless communication systems include frequency division duplexing (FDD) and time division duplexing (TDD). In the FDD mode, different carrier frequencies are used on the uplink and downlink, and a frequency guide period is used to separate the uplink signal from the downlink signal, thereby realizing simultaneous inter-frequency full duplex communication. In the TDD mode, different communication times are used on the uplink and downlink, and a time guide period is used to separate the received signal from the transmitted signal, thereby realizing common-frequency and asynchronous half duplex communication. Compared to the time sensed by the user, the time guide period used in the TDD mode is extremely short. The TDD mode is sometimes considered to support full duplex communication.

In theory, in a wireless communication system employing full duplex technology, the same time and the same frequency can be used on the uplink and downlink, and the spectral effect may be doubled. However, the full duplex technology is currently under study and is in the experimental stage. In addition, effectively reducing the impact of the local self-interference signal in receiving a radio signal from a remote end is still an important challenge to be overcome in the full duplex technology. Research currently being conducted is divided into two parts. One part relates to removing the local self-interference signal with a signal processed by an RF module, and the other part relates to optimizing the antenna to reduce the strength of the local self-interference signal reaching the RF module.

A typical BS antenna has a structure in which a single antenna element is arranged in a vertical direction according to the gain, and a circuit is implemented to connect the same to one connector. In such a structure, performance is determined based on the beam pattern and RF characteristics synthesized with an entire array rather than on the characteristics of a single element. In massive Multi Input Multi Output (massive MIMO), at least one element is directly connected to the connector, and a horizontal, vertical or arbitrary group is formed depending on the system to perform the function of a MIMO antenna. Unlike macro array antennas, the characteristics of a single element are important because performance of the entire system is influenced by the beam pattern of a single antenna element and RF performance.

In order to realize a miniaturization and low profile of an antenna in the massive MIMO, the ground area is limited and formed in a flat shape. Due to such conditions, the influence on neighboring antenna elements is relatively large, and thus, deterioration of Co-pol and X-pol isolation is noticeable. In addition, due to the asymmetry of the ground surface of the element, distortion and asymmetry of the beam pattern and cross polarization discrimination (XPD) are deteriorated, and the beam characteristics of the antenna elements located at the outer side and the center of the structure are not constant.

FIG. 1 is a diagram schematically showing a structure of a macro array antenna, and FIG. 2 is a diagram schematically showing a structure of a massive MIMO antenna.

Referring to FIG. 1, a macro array antenna has a maximum of 8 connectors based on the same band, and connectors are connected multiple times in the vertical direction. The beam characteristics in the vertical direction are determined by an array factor. The horizontal beam characteristics can be improved by implementing a panel with a bent portion on the left and right sides of the antenna element. The RF characteristics can be improved by implementing a matching circuit around a connection portion connected the connector, and isolation can be improved through a local improved structure.

As can be seen from part A in FIG. 2, at least one antenna element has an input/output connector, and therefore there is a limitation in implementing a matching circuit in a massive MIMO antenna. Antenna elements are coupled vertically and horizontally, and there is a limitation in individually implementing a circuit to suppress the coupling. In addition, it is difficult to implement a panel having a bent portion, and the beam pattern is distorted due to asymmetry of the ground surface according to the positions of the antenna elements.

Accordingly, there is a need to develop a structure capable of minimizing mutual influence between antenna elements and maintaining characteristics of individual antenna elements uniformly. In improving the beam pattern and isolation without increasing the size of the entire array and the height of the element, a cup-shaped structure may be effective. However, since the number of elements employed in massive MIMO is large and the space between the antenna elements is narrow, a technology capable of deriving stable characteristics with a simplified process is required.

SUMMARY

Technical Problem

Therefore, the present disclosure has been made in view of the above problems, and it is one object of the present disclosure to provide a dual polarized antenna and an antenna array that minimize mutual influence between antenna elements and maintain characteristics of individual antenna elements uniformly.

It is another object of the present disclosure to provide a dual polarized antenna and an antenna array including a cup-shaped aluminum structure and capable of being manufactured in a simplified process.

It is another object of the present disclosure to provide a dual polarized antenna and an antenna array that are implemented in an integrated form unlike the conventional assembly, thereby making it easy to secure structural stability and uniformity and remarkably reducing process time compared to manual operation through process automation.

It will be appreciated by persons skilled in the art that the objects that can be achieved with the present disclosure are not limited to what has been particularly described hereinabove and other objects that can be achieved with the present disclosure will be more clearly understood from the following detailed description.

Technical Solution

In accordance with the present disclosure, the above and other objects can be accomplished by the provision of a double polarized antenna including: a top portion having a radiation patch; a bottom portion forming a probe; and a side portion formed along an outer peripheral surface of the top portion so as to have a predetermined height, wherein the side portion includes a cup-shaped aluminum structure, wherein the top portion, the bottom portion and the side portion are formed in an integrated form.

According to the present disclosure, mutual influences between antenna elements may be minimized, and characteristics of individual antenna elements may be uniformly maintained.

In addition, according to the present disclosure, a cup-shaped aluminum structure is provided, and may be manufactured in a simplified process.

Further, according to the present disclosure, unlike the conventional assembly, structural stability and uniformity may be easily secured by implementing an integrated form, and the process time may be remarkably reduced compared to manual operation through process automation.

The effects obtainable in the present disclosure are not limited to the above-mentioned effects, and other effects not mentioned hereinwill be clearly understood by those skilled in the art from the following description.

DETAILED DESCRIPTION

Hereinafter, preferred embodiments of the present disclosure will be described in detail with eference to the accompanying drawings for thorough understanding of the configuration and effects of the present disclosure, Ho the present disclosure is not limited to the embodiments disclosed below. The present disclosure may be implemented in various forms and various modifications may be made thereto. It should be understood that the description of the embodiments is provided such that the disclosure will be thorough and complete, and will fully convey the concept of the invention to those skilled in the art In the accompanying drawings, the size of the components is enlarged from the actual size for convenience of description, and the ratio of each component may be exaggerated or reduced.

When it is stated that one component is "on" or "adjacent to" another, this statement should be understood as meaning that one component may be in direct contact with or directly connected to the other one or another component may be present between the components. On the other hand, when it is stated that one component is "directly on" or "directly adjacent to" another, this statement can be understood as meaning that no other component is interposed between the components. Other expressions that describe the relationship between components, for example, "between" and "directly between" can be construed in a similar manner.

Terms including ordinal numbers such as first, second, etc. may be used in describing components, and the components should not be limited by these terms. The terms can be used only for the purpose of distinguishing one component from another. For example, a first component may be referred to as a second component, and similarly, the second component may also be referred to as a first component without departing from the scope of the present disclosure.

A singular expression includes a plural expression unless the two expressions are contextually different from each other. In this specification, a term "include" or "have" is intended to indicate that characteristics, figures, steps, operations, constituents, and parts disclosed in the specification or combinations thereof exist. The term "include" or "have" should be understood as not pre-excluding possibility of addition of one or more other characteristics, figures, steps, operations, constituents, parts, or combinations thereof.

Unless defined otherwise, terms used in the embodiments of the present disclosure may be interpreted as meanings commonly known to those of ordinary skill in the art.

Figure 1:
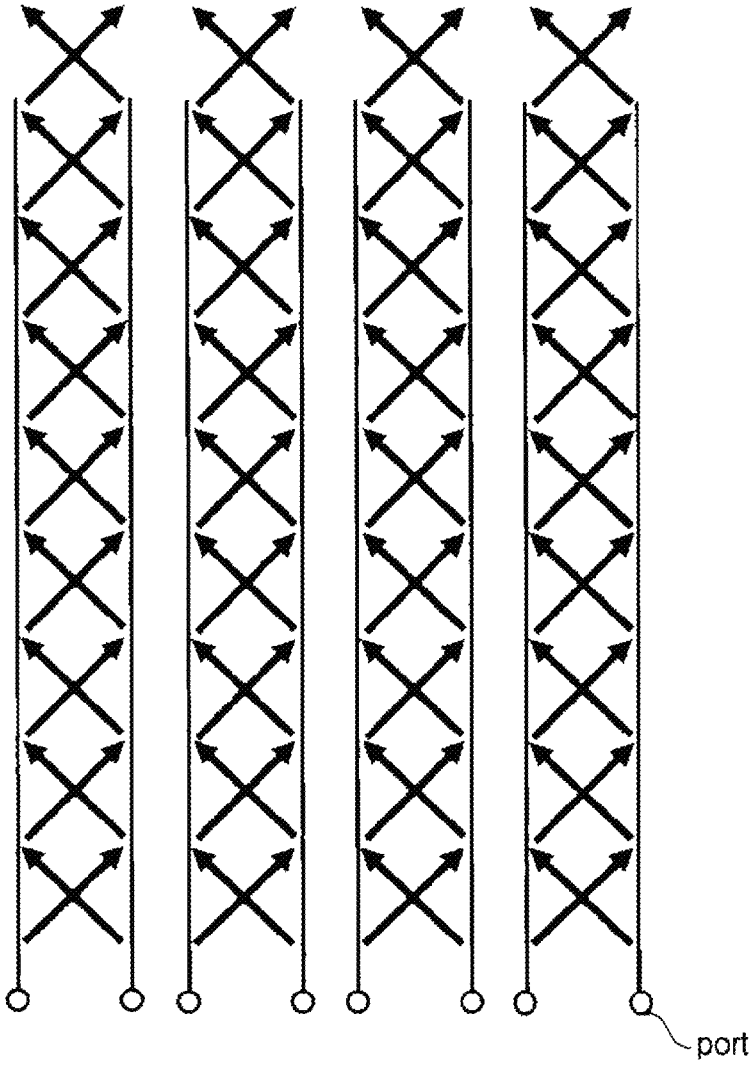
FIG. 1 is a diagram schematically showing a structure of a macro array antenna.
Figure 2:
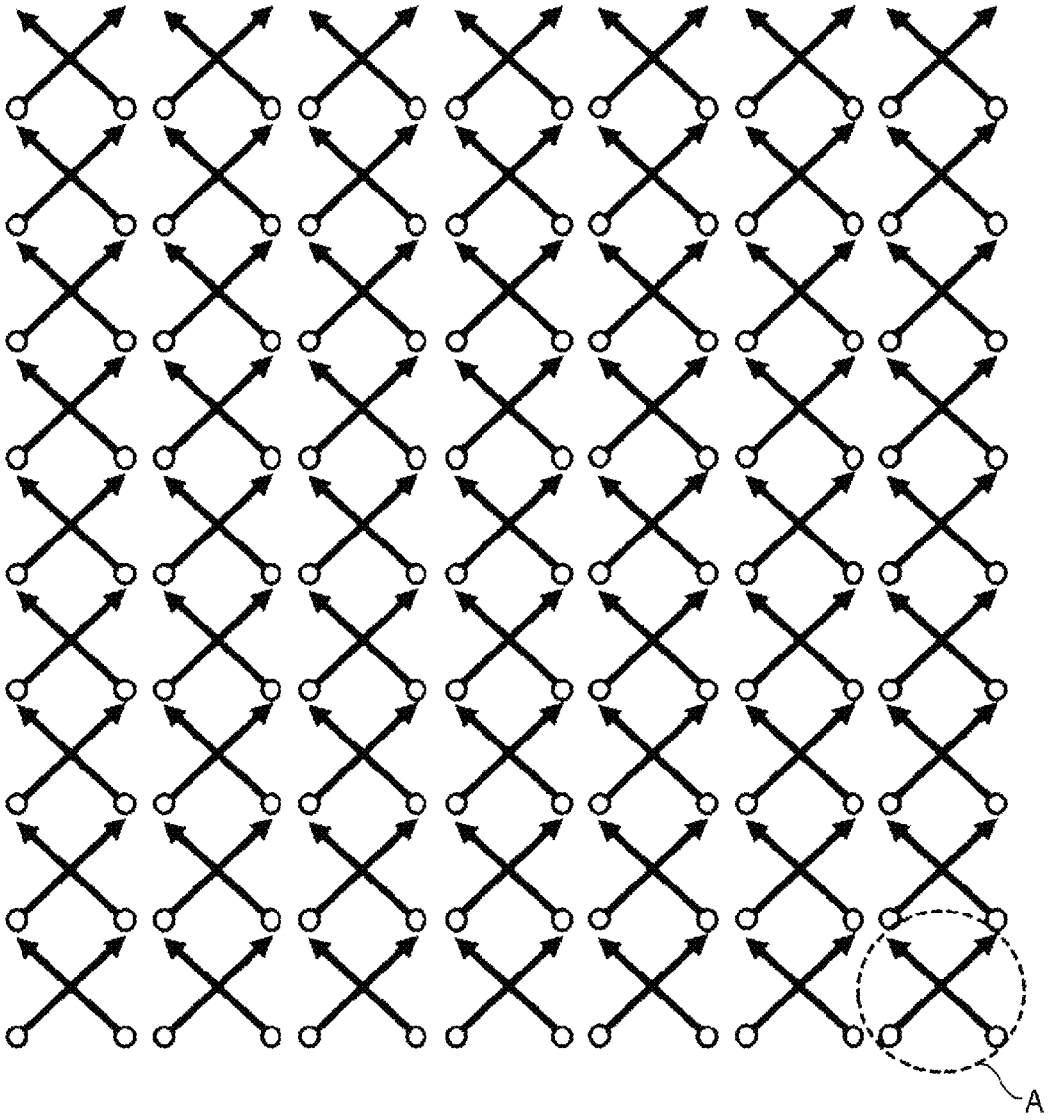
FIG. 2 is a diagram schematically showing a structure of a massive MIMO antenna.
Figure 3A:
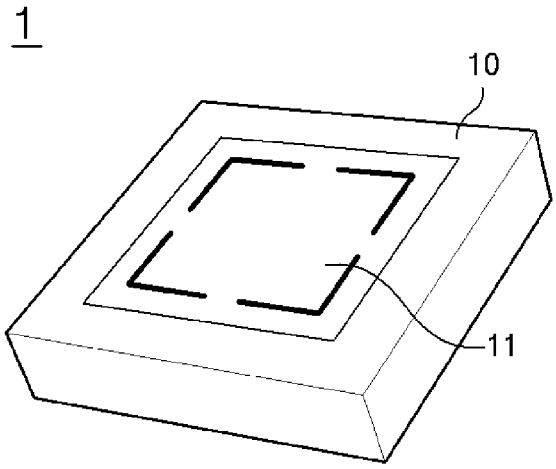
FIG. 3A is a front perspective view of an antenna element according to an embodiment of the present disclosure.
Figure 3B:
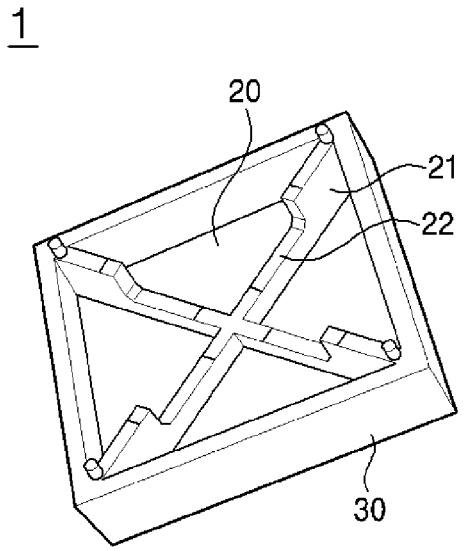
FIG. 3B is a rear perspective view of the antenna element according to the embodiment of the present disclosure.
Figure 3C:
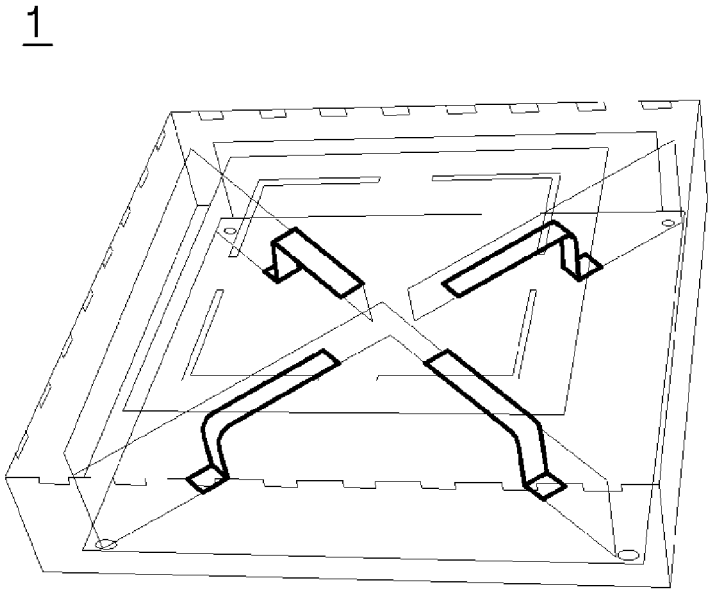
FIG. 3C is a perspective view illustrating a patterning configuration of a bottom portion in the antenna element according to the embodiment of the present disclosure.
Figure 3D:
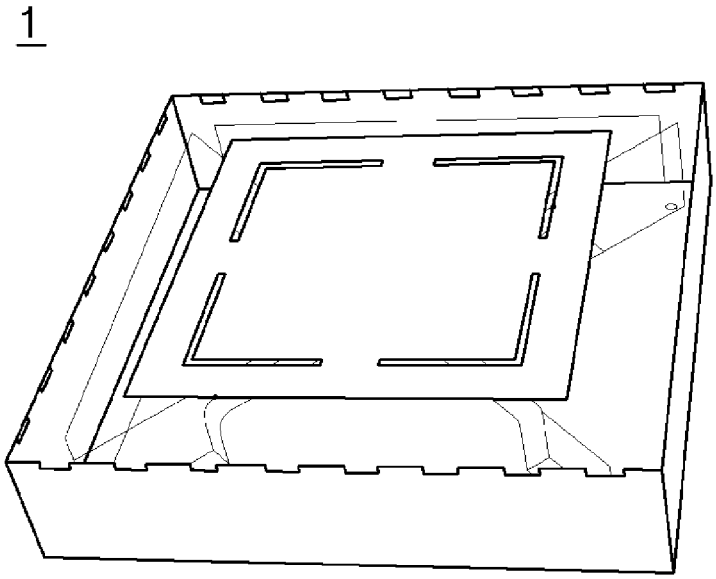
FIG. 3D is a perspective view illustrating a ground configuration of the antenna element according to the embodiment of the present disclosure.

FIG. 3A is a front perspective view of an antenna element according to an embodiment of the present disclosure, and FIG. 3B is a rear perspective view of the antenna element according to the embodiment of the present disclosure. FIG. 3C is a perspective view illustrating a patterning configuration of a bottom portion in the antenna element according to the embodiment of the present disclosure, and FIG. 3D is a perspective view illustrating a ground configuration of the antenna element according to the embodiment of the present disclosure.

Referring to FIGS. 3A and 3B, an antenna element 1 according to an embodiment of the present disclosure may include a top portion 10, a bottom portion 20, and a side portion 30, and may have a dielectric structure in which each of these components is formed in an integrated form.

The top portion 10 includes a radiation patch 11 having an area equal to or smaller than the area of the top portion 10.

Here, the radiation patch is metallic and may be implemented in various shapes such as a rectangle, a rhombus, or a circle. In addition, in order to improve the RF characteristics, it may be changed into any shape, which may include a shape of some slots.

The radiation patch 11 may be provided with a metallic property by surface processing, that is, etching of a dielectric structure in which the top portion 10, the bottom portion 20, and the side portion 30 are combined, through a laser based on the laser direct structuring (LDS) technology and the like. Alternatively, it may be implemented by fabricating and fusing a separate metal structure.

The bottom portion 20 forms probes 21. Here, each probe is formed to face from each corner of the bottom portion 20, which has a rectangular shape, toward the center. Although 'L'-shaped probes are shown in FIG. 3B, this is merely a basic shape of the probe. The probes may be implemented in various shapes to improve RF characteristics. A patterning part 22 is formed on one surface of the probe 21 such that the feed signal is connected thereto.

The side portion 30 is formed to have a predetermined height along the outer peripheral surface of the top portion. Here, the side portion 30 includes a cup-shaped aluminum structure for isolation and prevention of cross polarization. The aluminum structure is a structure made of aluminum and formed to surround the outer peripheral surface of the side portion 30. In addition, this aluminum structure may be implemented to have a height less than or equal to the height of the antenna element 1 for the purpose of improving RF characteristics. It may be implemented in a sawtooth shape or a slot shape, and may be implemented in a pattern having the property of frequency selective surface (FSS).

The aluminum structure may be formed through metal plating, or may be directly made to have a metal property by surface processing, that is, etching, through a laser based on the laser direct structuring (LDS) technology. Alternatively, it may be implemented by manufacturing a separate metal structure and fusing the same. That is, the aluminum structure may be formed through one of a first method of metal plating, a second method of surface processing through a laser, and a third method of fusing a separate metal structure.

However, the integrated antenna element shown in FIGS. 3A and 3B merely corresponds to an embodiment. The antenna element may be configured and combined with a PCB. In the case of this combined type, the band may be changed by replacing the PCB at any time.

Referring to FIG. 3C, the antenna element 1 is patterned on the bottom portion 20, wherein the patterning is performed on the probe 21 of the bottom portion 20. Referring to FIG. 3D, ground of the antenna element 1 is formed on the top portion 10 and the side portion 30.

The antenna element of this configuration may be mounted on, for example, a printed circuit board (PCB) on which a 33 massive MIMO system is implemented, and the circuit may be connected to the probe by soldering. An RF signal is transmitted from the PCB to the probe. The RF signal is induced in the radiation patch through electromagnetic coupling. The induced RF signal is radiated into space through the radiation patch to serves as an antenna.

Figure 4:
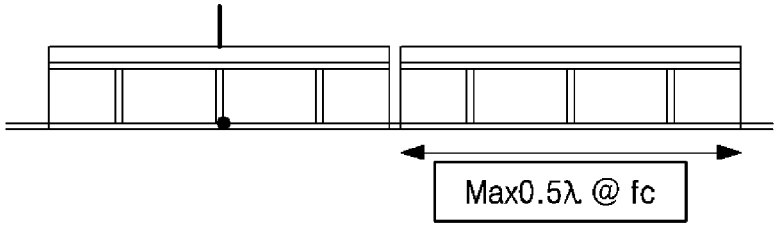
FIG. 4 is a side view of an example of disposition of the antenna element according to the embodiment of the present disclosure.

FIG. 4 is a side view of an example of disposition of the antenna element according to the embodiment of the present disclosure.

In general, the array spacing of a massive MIMO antenna is at least 0.5 lamda. Accordingly, FIG. 4 shows an example of a structure optimized to have sufficient characteristics without interference in the arrangement with the spacing of at least 0.5 lamda. In a single antenna element including the aluminum structure, widening the array spacing with the optimized reflection characteristics has no significant effect. Also, in general, as the array spacing increases, the isolation increases to converge.

As the array spacing of the optimized radiation patterns arranged at the minimum spacing becomes wider, the characteristics converge to the theoretical array characteristics by the array factor.

Figure 5:
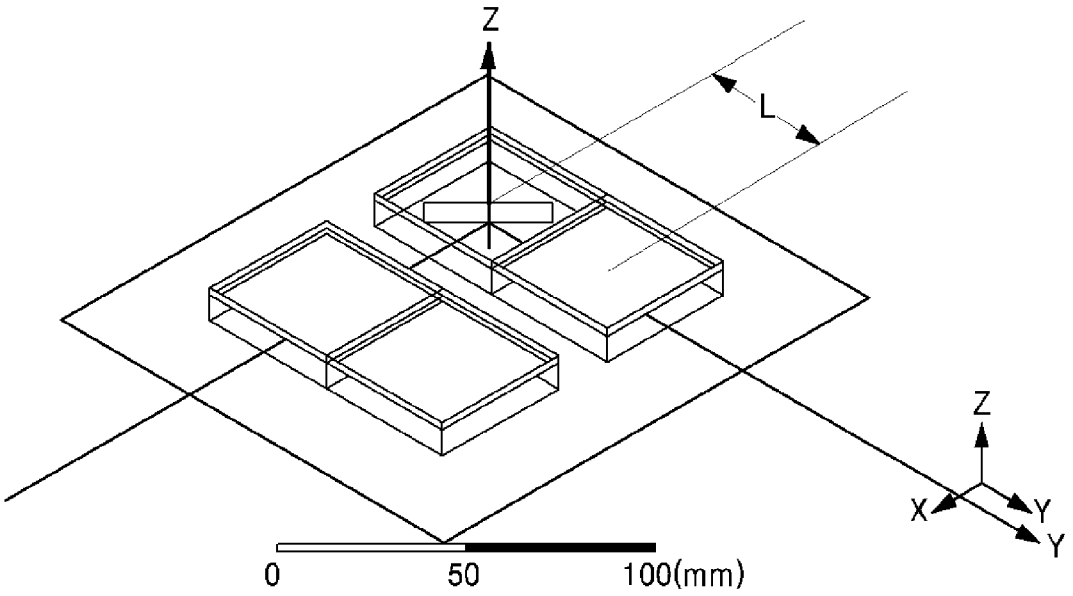
FIG. 5 is an isometric view of disposition of the antenna element according to the embodiment of the present disclosure.

FIG. 5 is an isometric view of disposition of the antenna element according to the embodiment of the present disclosure.

Referring to FIG. 5, a single antenna element may be freely disposed horizontally and vertically at a separation distance L greater than or equal to 0.5 lamda. The vertical and horizontal separation distances may be equal to or different from each other. For example, it may be arranged in the same row and column, or in a zigzagged manner. The arrangement is not limited. Here, the separation distance L is a length optimized for isolation.

That is, a plurality of dual polarized antennas may be arranged in an array form on a plane, and spaced from each other by 0.5 lamda or more to configure a polarized antenna array.

Here, since the characteristics of the antenna element 1 and the side portion 30 are aligned, there is no effect on the ground. The side portion 30 is formed first and the size of the radiation pattern is determined according to the characteristics thereof.

Figure 6A:
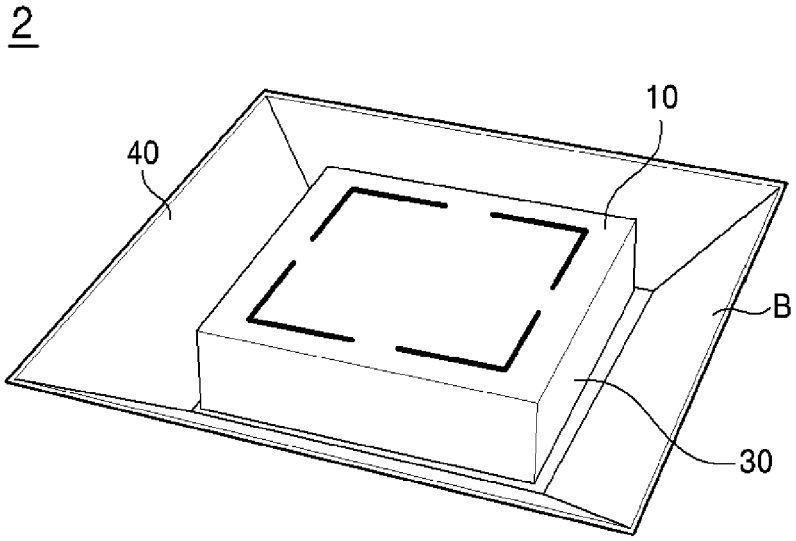
FIG. 6A is a front perspective view of an antenna element according to another embodiment of the present disclosure.
Figure 6B:
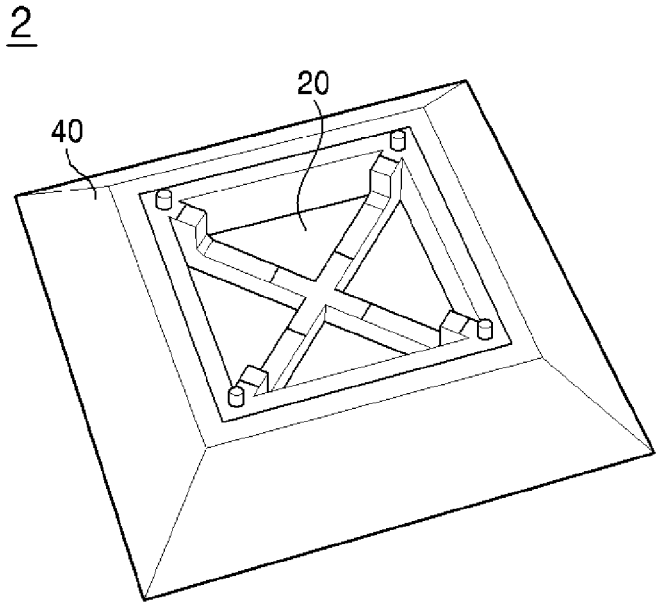
FIG. 6B is a rear perspective view of the antenna element according to the other embodiment of the present disclosure.

FIG. 6A is a front perspective view of an antenna element according to another embodiment of the present disclosure, and FIG. 6B is a rear perspective view of the antenna element according to the other embodiment of the present disclosure.

Referring to FIGS. 6A and 6B, an antenna element 2 according to another embodiment of the present disclosure, which is basically the same as the structure of the antenna element 1 shown in FIGS. 3A and 3B, further includes a shielding wall portion 40. The shielding wall portion 40 is formed to extend from the outer peripheral surface of the bottom portion 20 toward the top portion 10 at a predetermined angle. In the case of the antenna element 2 according to this other embodiment, the shielding wall portion 40 rather than the side portion 30 includes a cup-shaped aluminum structure.

Similarly, this aluminum structure may be directly formed to have metal properties through metal plating or surface processing, that is, etching, through a laser based on the LDS technology. Alternatively, it may be implemented by manufacturing a separate metal structure and then fusing the same.

The angle of the beam width of one antenna element 2 may be 60° to 65°. Here, the beam width may be changed according to the angle of the shielding wall portion 40.

The antenna element 2 may be formed by filling the entire portion within part B with a dielectric and performing patterning.

Figure 7A:
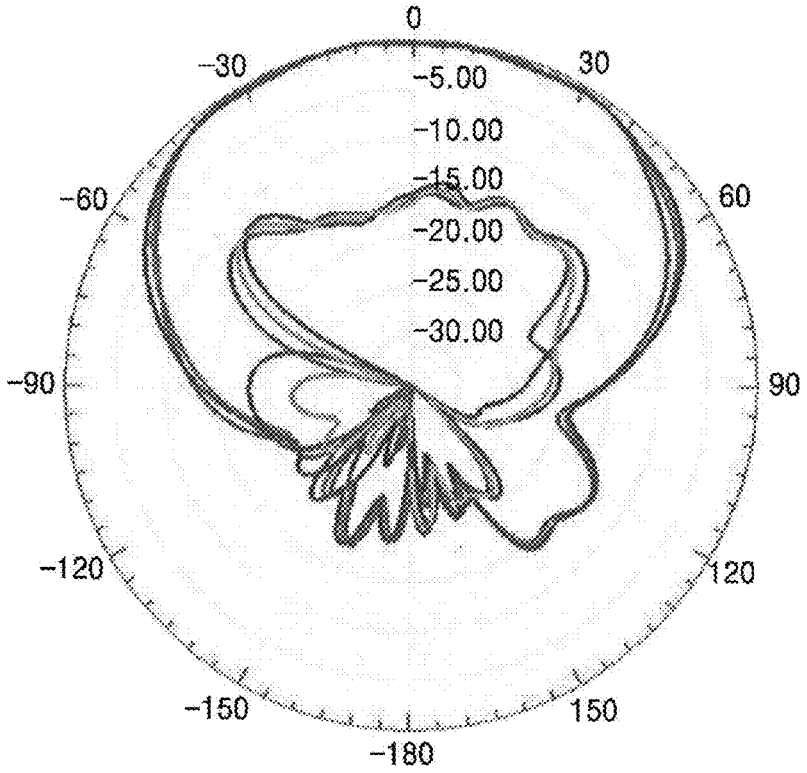
FIG. 7A is a diagram showing an antenna radiation pattern for an antenna element according to the prior art.
Figure 7B:
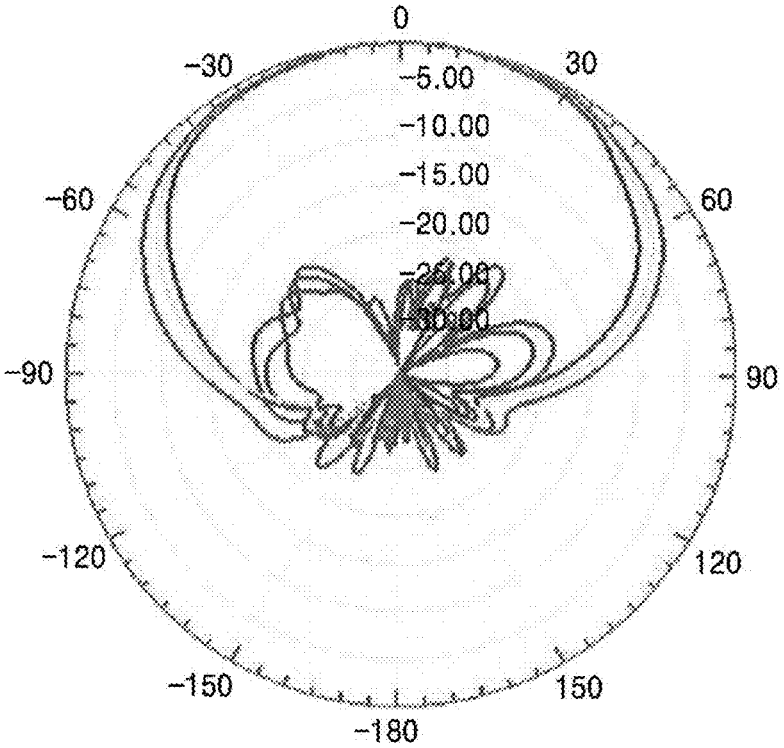
FIG. 7B is a diagram showing an antenna radiation pattern for an antenna element according to the present disclosure.

FIG. 7A is a diagram showing an antenna radiation pattern for an antenna element according to the prior art, and FIG. 7B is a diagram showing an antenna radiation pattern for an antenna element according to the present disclosure.

Referring to FIGS. 7A and 7B, with the antenna element according to the present disclosure, an F/B ratio may be improved. Compared to the conventional radiation pattern, the F/B ratio at 130° is improved from 15 dBc to 25 dBc or more, thereby addressing interference with the side rear sector. XPD at 0° may also be improved from 15 dBc to 25 dBc compared to the conventional radiation pattern, and accordingly the MIMO effect may be improved.

Furthermore, the antenna element according to the present disclosure is implemented as an integrated unit unlike the conventional assembly, and therefore may secure structural stability and uniformity. The antenna element has a structure that can be mounted on a PCB having a massive MIMO system by applying an automated process. Accordingly, mis-assembly caused by manual operation may be prevented and assembly quality and stability may be secured. All the above processes may be automated, and thus process time may be dramatically reduced compared to manual operation.

In the present specification and drawings, preferred embodiments of the present disclosure have been disclosed. Although specific terms are used, these are only used in a general meaning to easily explain the technical content of the present disclosure to provide understanding of the disclosure, and are not intended to limit the scope of the present disclosure. It is apparent to those of ordinary skill in the art that, in addition to the embodiments disclosed herein, other modifications are possible based on the technical idea of the present disclosure.

What is claimed is:

1. A dual polarized antenna comprising:

a top portion having a radiation patch;

a bottom portion forming a probe; and a side portion formed to have a predetermined height along an outer peripheral surface of the top portion, wherein the side portion comprises a cup-shaped aluminum structure, wherein the top portion, the bottom portion and the side portion are formed in an integrated form.

2. The dual polarized antenna of claim 1, wherein the bottom portion has a rectangular shape, wherein the probe is formed from each corner of the bottom portion of the rectangular shape to face a center of the bottom portion.

3. The dual polarized antenna of claim 1, wherein the side portion further comprises a shielding wall portion extending along an outer peripheral surface of the bottom portion so as to have a predetermined angle with respect to the top portion, wherein the aluminum structure is formed on the shielding wall portion.

4. The dual polarized antenna of claim 1, wherein the aluminum structure is formed to have a height less than or equal to a height of antenna element.

5. The dual polarized antenna of claim 1, wherein an area of the radiation patch is equal to or smaller than an area of the top portion, wherein the radiation patch has a shape of one of a rectangle, a rhombus, a circle, a triangle, and an octagon.

6. The dual polarized antenna of claim 1, wherein the aluminum structure is formed by one of a first method of metal plating, a second method of surface processing through a laser, and a third method of fusing a separate metal structure.

7. The dual polarized antenna of claim 1, wherein the probe has an 'L' shape.

8. The dual polarized antenna of claim 1, wherein the aluminum structure is formed in a sawtooth shape or a slot shape.

9. A dual polarized antenna array comprising a plurality of the dual polarized antennas of claim 1 arranged in an array form on a plane, wherein a distance between the dual polarized antennas is greater than or equal to 0.5 lamda.

* * * * *